United States Patent [19]

Tuller

[11] 4,229,785

[45] Oct. 21, 1980

[54] FLOODLIGHT REFLECTOR MOUNTING

[75] Inventor: Clarence J. Tuller, Hendersonville, N.C.

[73] Assignee: General Electric Company, Schenectady, N.Y.

[21] Appl. No.: 4,339

[22] Filed: Jan. 18, 1979

[51] Int. Cl.[2] ..... F21V 17/06

[52] U.S. Cl. ..... 362/433; 362/435; 362/217; 362/306

[58] Field of Search ..... 362/433, 434–437, 362/353, 217, 306

[56] References Cited

U.S. PATENT DOCUMENTS

| | | | |
|---|---|---|---|
| 2,569,772 | 12/1951 | Olsen | 362/217 |
| 3,231,734 | 1/1966 | Stiffel | 362/433 |
| 3,355,583 | 11/1967 | Sellenraad et al. | 362/433 |
| 3,609,337 | 9/1971 | Adsa et al. | 362/306 |
| 3,712,978 | 1/1973 | Lowell | 362/437 |
| 3,944,809 | 3/1976 | Moore et al. | 362/433 |
| 4,027,151 | 5/1977 | Barthel | 362/217 |

*Primary Examiner*—Benjamin R. Padgett
*Assistant Examiner*—J. L. Barr
*Attorney, Agent, or Firm*—Sidney Greenberg; Lawrence R. Kempton; Philip L. Schlamp

[57] ABSTRACT

Flexible sheet reflector for floodlight is supported at its ends by cradle members having parabolic openings into which the reflector ends are inserted, so that the reflector is formed and held in the desired shape by the cradle members, thereby avoiding distortion of the reflector which would otherwise result from the use of screw mountings or other fasteners.

7 Claims, 4 Drawing Figures

FLOODLIGHT REFLECTOR MOUNTING

The present invention relates to floodlights, and particularly to floodlight reflector supports.

It is an object of the invention to provide an improved support device for floodlight reflectors.

It is a particular object of the invention to provide a reflector support device for holding a flexible reflector in a predetermined curved position without substantial distortion.

Still another object of the invention is to provide a reflector support of the above type which facilitates mounting of the reflector thereon and automatically forms and holds the reflector in the desired shape upon assembly therewith.

Other objects and advantages will become apparent from the following description and the appended claims.

With the above objects in view, the present invention in one of its aspects relates to a floodlight comprising, in combination, a housing having a window, a pair of spaced cradle members mounted in the housing adjacent the window, each cradle member formed with an opening having a portion of predetermined shape, and a flexible reflector member inserted at opposite sides into the openings of the spaced cradle members and arranged facing the window, the cradle members holding the reflector member in the predetermined shape.

The invention will be better understood from the following description taken in conjunction with the accompanying drawing, in which.

Figure 1:
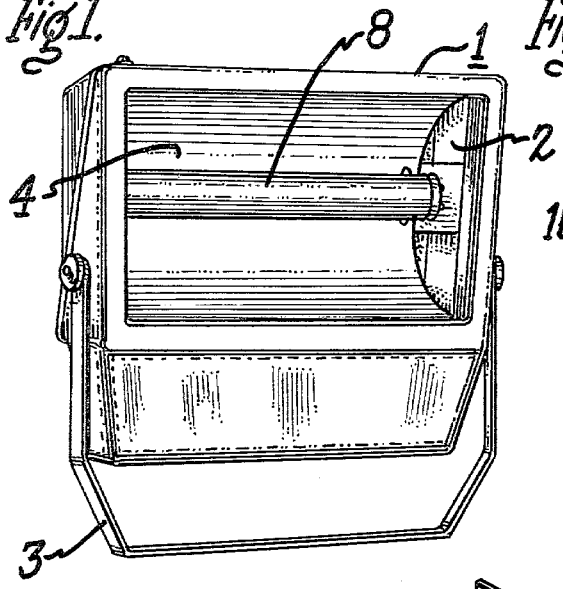
FIG. 1 is a perspective view in elevation of a floodlight in which the invention is embodied.

Referring now to the drawing and particularly to FIG. 1, there is shown a floodlight in which the invention is embodied and comprising housing 1 of generally rectangular shape having an open front closed by transparent window 2 such as a glass pane. Housing 1 in the embodiment illustrated comprises front and rear sections 1*a*, 1*b* (see FIG. 2) which mate along a diagonal line as shown. Trunnion bracket 3 for mounting the floodlight on a suitable support surface is pivotally attached to front housing section 1*a* so that the floodlight may be adjusted to desired position about the pivot axis.

Mounted within housing 1 is reflector 4, and elongated lamp 5 is arranged extending across the housing interior between reflector 4 and window 2. Typically, reflector 4 is parabolic in form with lamp 8 being placed at the focus of the parabola, so that the light rays emanate in parallel paths from the floodlight for illuminating the desired area. In the past, reflector 4, which is usually in the form of a thin aluminum sheet with a specular reflecting surface, has been secured to its mounting means by screws or other fasteners, but in such prior constructions it has been found that the reflector sheet was somewhat distorted due to its manner of mounting and, further, the mounting means caused variations in the shape of the reflector in different units. As a result, the light distribution from such floodlights often was not of a consistent or precise pattern.

Figure 2:
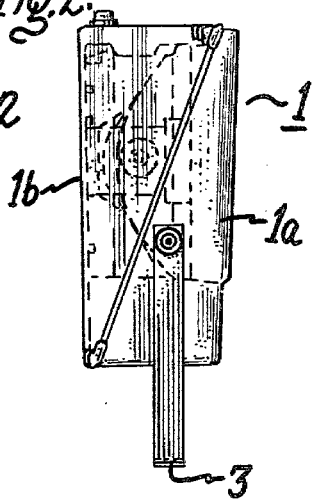
FIG. 2 is a side view of the FIG. 1 floodlight.

In accordance with the present invention, mounting means are provided for reflector sheet 4 which hold the reflector in the desired configuration without the use of screws or other fasteners which might cause distortion of the reflector as described above. In the embodiment illustrated in FIGS. 3 and 4, the improved mounting means comprise a pair of spaced cradles 5 and 6 formed of plate members, typically of metal such as steel, having generally D-shaped openings 7 formed therein as shown. Typically, the curved portion C of each opening is parabolic in form and intersects the straight portion S at opposite ends. The cradles are formed along one side with flanges 5*a*, 6*a* by means of which the cradles are suitably secured (by screws or the like) to the interior rear wall of housing 1, so that the opposite edges of the cradles face the front window of the floodlight housing, as seen in FIG. 2.

Figure 3:
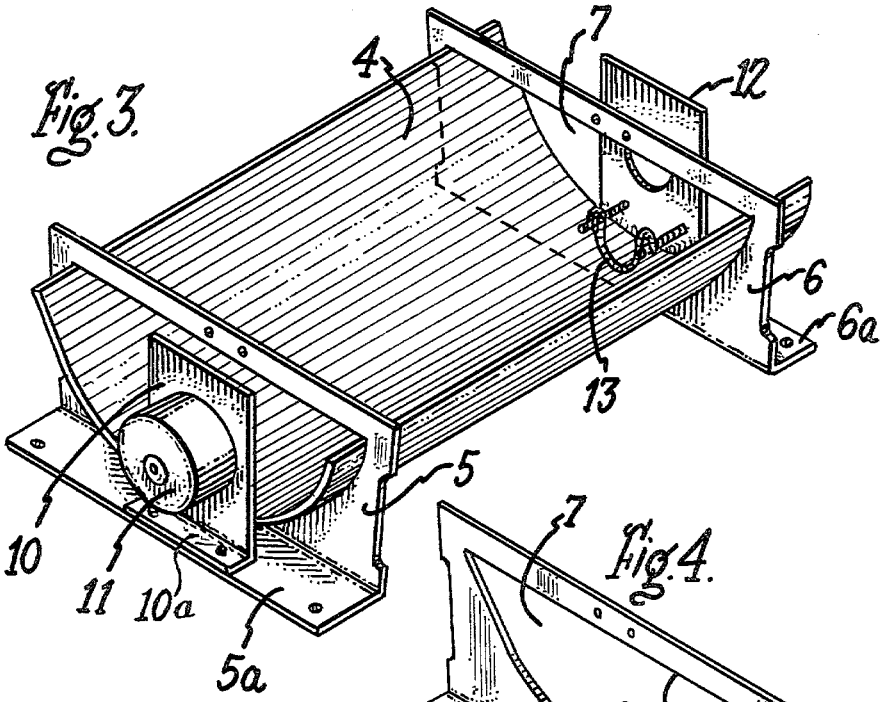
FIG. 3 is a perspective view of the floodlight reflector support device constructed in accordance with an embodiment of the invention.
Figure 4:
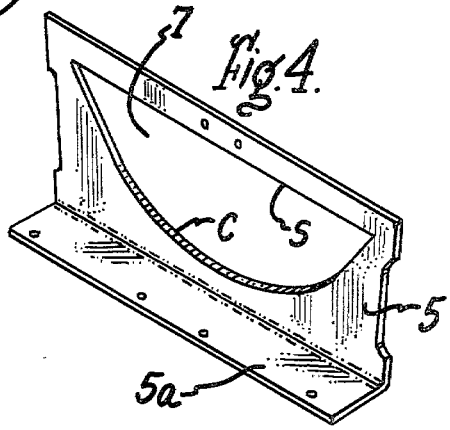
FIG. 4 is a perspective view of one of the cradle members of the reflector support device.

Flexible sheet reflector 4 is mounted in support cradles 5, 6 simply by inserting it at opposite sides into the openings of the respective cradles, as seen in FIG. 3. The dimensions of reflector sheet 4 relative to the cradle openings are such that when thus inserted, the reflector sheet rests against and conforms to curved portion C of the openings while the opposite edges of the reflector sheet abut the straight edge portion S of the cradle openings. In this way, the flexible reflector sheet is formed in a parabolic curvature corresponding to the parabolic shape of the cradle openings and is firmly maintained in such position and form without the use of screws or other fasteners such as employed in prior types of fixtures. By virtue of the described arrangement, the reflector curvature conforms to the particular curvature in which the cradle openings are precision formed, such as by punching or die cutting, and as a result the light distribution pattern is closely controlled and maintained constant in different floodlight fixtures.

As seen in FIG. 3, lamp socket support bracket 10 is secured by flange 10*a* to flange 5*a* of cradle 5 so that the axis of lamp socket 11 is aligned with the focus of parabolic reflector 4 through the cradle openings, while lamp end support bracket 12 with attached lamp support 13 is similarly mounted on cradle 6.

Where necessary or desirable, the opposite edge portions of reflector 4 between the spaced cradles 5, 6 may be formed with flanges to stiffen those portions of the reflector for avoiding outward bulging. Typically, the reflector is formed of sheet aluminum about 0.02 inches thick, but other materials such as steel of 0.012 inch thickness or less, or a suitable plastic material with a reflecting coating thereon may be employed where appropriate.

While the reflector-forming openings in cradle members 5, 6 have been described as parabolic, it will be understood that other shapes may be employed such as elliptical, spherical, or a combination of curved shapes for providing the desired reflected light pattern.

Although the reflector is shown in the illustrated embodiment as supported by only two cradle members, it will be understood that one or more similar cradle members may be placed between the end cradles, where such additional support for the reflector appears necessary or desirable.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A lighting fixture comprising, in combination, a housing having a window, a plurality of spaced cradle members mounted in said housing adjacent said window, each cradle member formed with an opening having a portion of predetermined shape, and a flexible reflector member inserted at opposite sides into the openings of said spaced cradle members and arranged facing said window, said cradle members holding said reflector member in said predetermined shape, said openings of said cradle members each being defined by a rear cradle portion for shaping said reflector and front cradle portions for holding said reflector against said rear cradle portion.

2. A lighting fixture as defined in claim 1, said cradle members constituting the sole means for holding said reflector member.

3. A lighting fixture as defined in claim 2, said openings of said cradle members each being defined by a curved portion intersectinhg a straight portion, said flexible reflector member lying against and formed by said curved portion and abutting said straight portion at its edges.

4. A lighting fixture as defined in claim 3, said curved portion being parabolic.

5. A lighting fixture as defined in claim 1, and lamp support means secured to said cradle members for holding a lamp along an axis passing through said openings.

6. A lighting fixture as defined in claim 5, said openings of said cradle members each being defined by a parabolic portion intersecting a straight portion, said axis being substantially at the focus of said parabolic portion.

7. A lighting fixture as defined in claim 1, said plurality of spaced cradle members comprising a pair of plate-like members each having a flange along one side, said members being attached at said flanges to said housing.

* * * * *